US007514857B2

(12) United States Patent
Hong et al.

(10) Patent No.: US 7,514,857 B2
(45) Date of Patent: Apr. 7, 2009

(54) ELECTRON EMISSION DEVICE AND ELECTRON EMISSION DISPLAY DEVICE USING THE SAME

(75) Inventors: Su-Bong Hong, Yongin-si (KR); Chun-Gyoo Lee, Yongin-si (KR); Sang-Jo Lee, Yongin-si (KR); Sang-Ho Jeon, Yongin-si (KR); Sang-Hyuck Ahn, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 558 days.

(21) Appl. No.: 11/388,688

(22) Filed: Mar. 24, 2006

(65) Prior Publication Data

US 2006/0219995 A1 Oct. 5, 2006

(30) Foreign Application Priority Data

Mar. 31, 2005 (KR) ..... 10-2005-0026992

(51) Int. Cl.
*H01J 1/62* (2006.01)
*H01J 5/02* (2006.01)

(52) U.S. Cl. ..... 313/495; 313/497

(58) Field of Classification Search ..... 313/495–497, 313/309, 336, 351

See application file for complete search history.

(56) References Cited

U.S. PATENT DOCUMENTS

2005/0052108 A1 3/2005 Motoi et al.

FOREIGN PATENT DOCUMENTS

EP 1 429 363 A2 6/2004
EP 1 542 258 A2 6/2005
EP 1 542 258 A3 9/2005
EP 1 429 363 A3 6/2006
JP 7-153369 A 6/1995
JP 7-282716 A 10/1995
JP 8-115654 A 5/1996
JP 9-274845 A 10/1997
JP 2000-123713 A 4/2000
JP 2003-249163 A 9/2003

OTHER PUBLICATIONS

European Search Report dated Jul. 31, 2006 for EP 06111889.9, in the name of Samsung SDI Co., Ltd. corresponding to priority KR 10-2005-0026992.

*Primary Examiner*—Joseph L Williams
(74) *Attorney, Agent, or Firm*—Christie, Parker & Hale, LLP

(57) ABSTRACT

An electron emission device includes a substrate; a cathode electrode formed on the substrate; a gate electrode crossing the cathode electrode and insulated from the cathode electrode; and an electron emission region electrically connected to the cathode electrode. The cathode electrode includes a main electrode with an inner opening portion, an isolate electrode placed in the opening portion and spaced apart from the main electrode by a distance, and a resistance layer disposed between the main electrode and the isolate electrode. The isolate electrode has a via hole. The electron emission region contacts the isolate electrode, and is placed in the via hole. The isolate electrode has a first height, and the electron emission region has a second height smaller than the first height.

17 Claims, 5 Drawing Sheets

ELECTRON EMISSION DEVICE AND ELECTRON EMISSION DISPLAY DEVICE USING THE SAME

CROSS REFERENCE TO RELATED APPLICATION

This application claims priority to and the benefit of Korean Patent Application No. 10-2005-0026992, filed on Mar. 31, 2005, in the Korean Intellectual Property Office, the entire content of which is incorporated herein by reference.

BACKGROUND OF THE INVENTION

Field of the Invention

The present invention relates to an electron emission device, and in particular, to an electron emission device having an improved cathode electrode structure and heightened electron beam focusing efficiency, and an electron emission display device with the electron emission device.

Description of Related Art

Depending upon the kinds of electron sources, electron emission elements can be classified into those using hot cathodes or those using cold cathodes.

There are several types of cold cathode electron emission elements including a field emitter array (FEA) type, a surface-conduction emission (SCE) type, a metal-insulator-metal (MIM) type, and a metal-insulator-semiconductor (MIS) type.

To construct an electron emission display device, an array of the electron emission elements is formed on a first substrate to make an electron emission device, and the electron emission device is combined with a second substrate having a light emission unit including a phosphor layer, a black layer, and an anode electrode.

In a common FEA-type electron emission display device, electron emission regions are formed on a first substrate, and cathode and gate electrodes are provided for respective sub-pixels as driving electrodes for controlling the emission of electrons from the electron emission regions. A phosphor layer, a black layer, and an anode electrode for accelerating the electron beams are formed on a surface of a second substrate facing the first substrate.

The electron emission regions are electrically connected to the cathode electrodes to receive electric currents required for the electron emission. The gate electrodes are placed on a plane different from the cathode electrodes, and an insulating layer is interposed between the gate electrodes and the cathode electrodes. For instance, the gate electrodes may be placed over the cathode electrodes in an insulating manner. Openings are formed at the gate electrodes and the insulating layer to expose the electron emission regions.

When predetermined driving voltages are applied to the cathode and gate electrodes, an electric field is formed around the electron emission regions at the sub-pixels where the voltage difference between the two electrodes exceeds a threshold value, and electrons are emitted from those electron emission regions. The emitted electrons are attracted by a high voltage applied to the anode electrode, and directed toward the second substrate to collide with the phosphors at the relevant sub-pixels and to emit light.

However, with the above-described light emission structure, the electric field is not uniformly focused over the entire area of an electron emission region. That is, the electric field is mainly focused on the upper periphery of the electron emission region facing a gate electrode, and electrons are emitted therefrom. The emitted electrons are spread toward the second substrate with random inclination angles, and land on the correct color phosphors of the corresponding sub-pixels as well as on the incorrect color phosphors at the sub-pixels neighboring thereto, thereby deteriorating the screen color purity.

Furthermore, with the operation of the electron emission display device, non-stable driving voltages are applied to the cathode electrodes, or non-stable voltage drops are made at the cathode electrodes, so that the electron emission regions at the respective sub-pixels may receive different driving voltages. In this case, the emission characteristics of the electron emission regions become non-uniform, and the light emission uniformity of the respective sub-pixels is deteriorated.

SUMMARY OF THE INVENTION

In one exemplary embodiment of the present invention, there is provided an electron emission device which heightens screen color purity by minimizing (or reducing or preventing) electron beams from being spread to enhance a light emission uniformity of sub-pixels by making emission characteristics of electron emission regions uniform, and an electron emission display device with the electron emission device.

In an exemplary embodiment of the present invention, the electron emission device includes a substrate; a cathode electrode formed on the substrate; a gate electrode crossing the cathode electrode and insulated from the cathode electrode; and an electron emission region electrically connected to the cathode electrode. The cathode electrode includes a main electrode with an inner opening portion, an isolate electrode placed in the opening portion and spaced apart from the main electrode by a distance, and a resistance layer disposed between the main electrode and the isolate electrode. The isolate electrode has a via hole. The electron emission region contacts the isolate electrode, and is placed in the via hole. The isolate electrode has a first height, and the electron emission region has a second height smaller than the first height.

The main electrode and the isolate electrode may partially cover a top surface of the resistance layer.

A plurality of isolate electrodes may be placed within the opening portion of the main electrode and spaced apart from each other by a distance. In this case, the resistance layer is formed at both sides of each of the isolate electrodes and between the main electrode and the isolate electrodes.

The electron emission device may further include a focusing electrode placed over the cathode electrode and the gate electrode and insulated from the cathode electrode and the gate electrode.

In an exemplary embodiment of the present invention, the electron emission display device includes a first substrate; a second substrate facing the first substrate; a cathode electrode formed on the first substrate; a gate electrode crossing the cathode electrode and insulated from the cathode electrode; an electron emission region electrically connected to the cathode electrode; a phosphor layer formed on a surface of the second substrate; and an anode electrode formed on a surface of the phosphor layer. The cathode electrode includes a main electrode with an inner opening portion, an isolate electrode placed in the opening portion and spaced apart from the main electrode by a distance, and a resistance layer disposed between the main electrode and the isolate electrode. The isolate electrode has a via hole. The electron emission region contacts the isolate electrode, and is placed in the via hole. The isolate electrode has a first height, and the electron emission region has a second height smaller than the first height.

DETAILED DESCRIPTION

Figure 1:
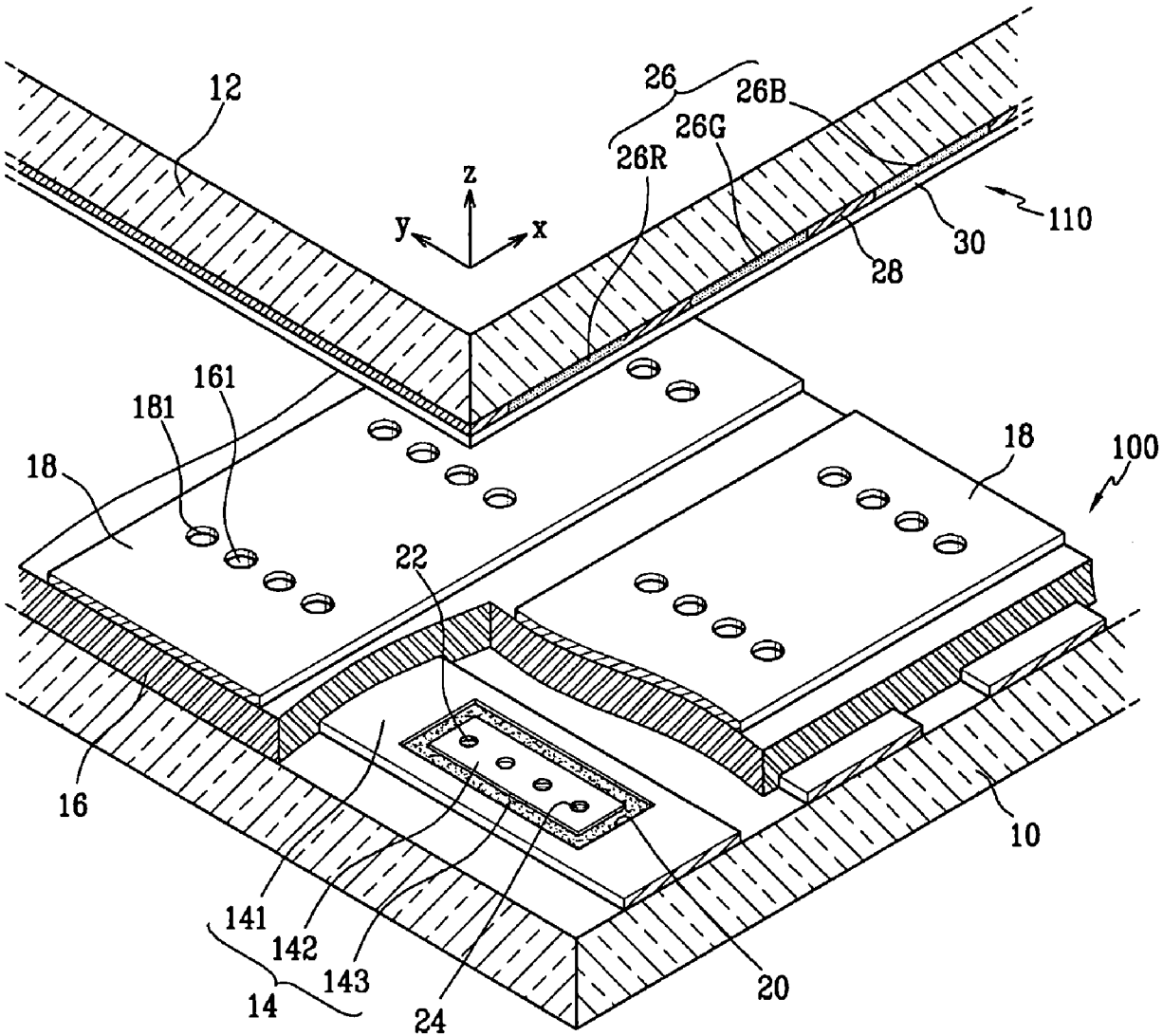
FIG. 1 is a partial exploded perspective view of an electron emission display device according to a first embodiment of the present invention.
Figure 2:
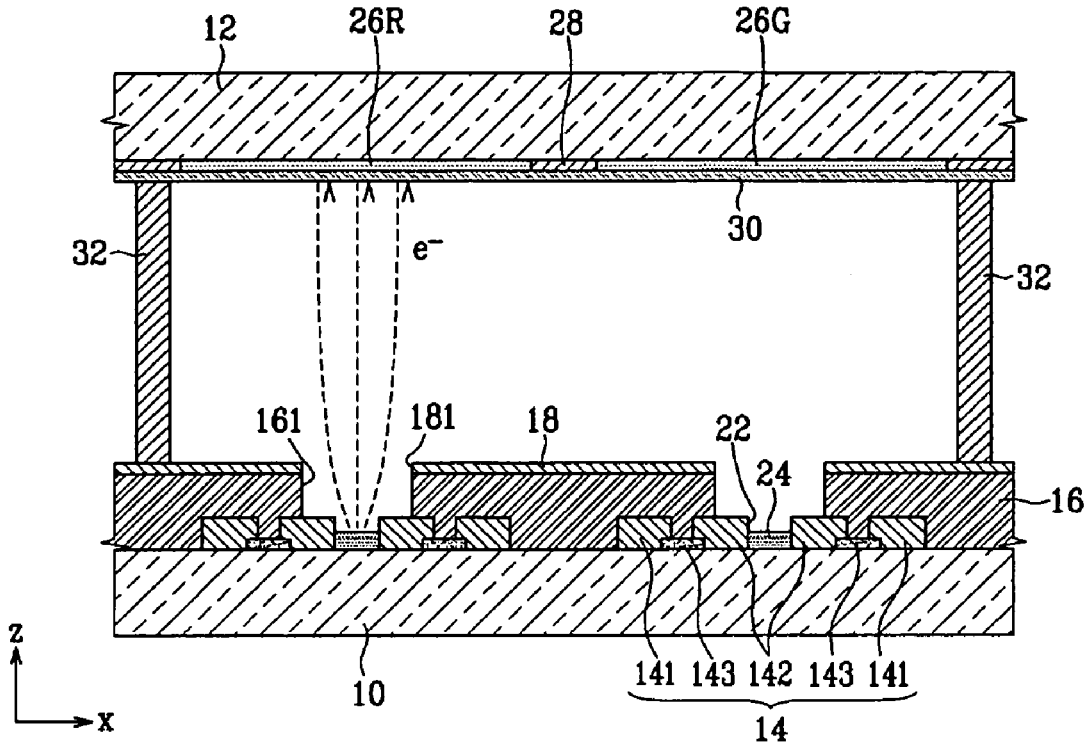
FIG. 2 is a partial sectional view of the electron emission display device according to the first embodiment of the present invention.
Figure 3:
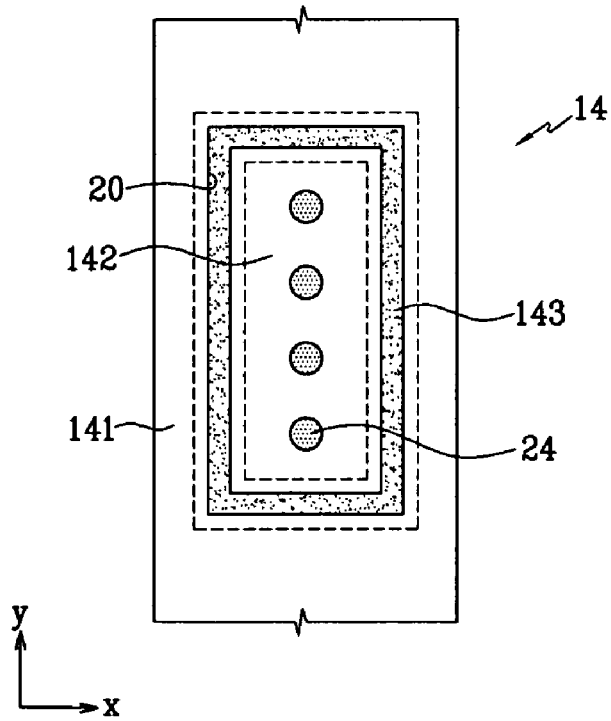
FIG. 3 is a partial amplified plan view of a cathode electrode and an electron emission region with the electron emission display device according to the first embodiment of the present invention.

As shown in FIGS. 1 to 3, an electron emission display device according to a first embodiment of the present invention includes first and second substrates 10 and 12 facing each other in parallel with a predetermined distance therebetween. A sealing member (not shown) is provided at the peripheries of the first and second substrates 10 and 12 to seal them, and the internal space between the two substrates 10 and 12 is evacuated to be at $10^{-6}$ Torr, thereby constructing a vacuum chamber (or a vacuum vessel) with the first and second substrates 10 and 12 and the sealing member.

An array of electron emission elements are formed on a surface of the first substrate 10 facing the second substrate 12 to construct an electron emission device 100 together with the first substrate 10. An electron emission display device is then formed with the electron emission device 100 in association with the second substrate 12 and a light emission unit 110 provided at the second substrate 12.

Cathode electrodes 14 are stripe-patterned on the first substrate 10 in a direction of the first substrate 10 as first electrodes, and an insulating layer 16 is formed on the entire surface of the first substrate 10 while covering the cathode electrodes 14. Gate electrodes 18 are stripe-patterned on the insulating layer 16 to cross (or to be perpendicular to) the cathode electrodes 14 as second electrodes. The cross regions of the cathode and gate electrodes 14 and 18 correspond to sub-pixels of the electron emission display device.

In this embodiment, each of the cathode electrodes 14 is provided with a main electrode 141 being stripe-patterned in a direction of the first substrate 10 and having an inner opening portion 20, an isolate electrode 142 spaced apart from the main electrode 141 with a distance therebetween, and a resistance layer 143 electrically interconnecting the main electrode 141 and the isolate electrode 142. The isolate electrode 142 internally has a plurality of via holes 22, and an electron emission region 24 is placed within each of the via holes 22.

The main electrode 141 and the isolate electrode 142 partially cover the top surface of the resistance layer 143 and have a thickness larger than the resistance layer 143 to reduce the contact resistance therebetween. The main electrode 141 and/or the isolate electrode 142 may be formed with a low resistivity material (or a conductive material) such as aluminum (Al) and/or molybdenum (Mo).

The resistance layer 143 has a resistivity from about 10,000 to 100,000 Ωcm such that it is higher in resistance than the conductive material for forming the main electrode 141 and/or the isolate electrode 142. For instance, the resistance layer 143 may be formed with a p- or n-type doped amorphous silicon. The resistance layer 143 may be ring-shaped with a width (which may be predetermined) for each of the sub-pixels such that it surrounds the entire periphery of the isolate electrode 142.

The resistance layer 143 electrically connects the main electrode 141 for receiving a driving voltage from the outside of the vacuum vessel with the isolate electrode 142 for mounting one or more of the electron emission regions 24 therein. With the operation of the electron emission display device, the resistance layer 143 assists in making the emission characteristics of the electron emission regions 24 substantially uniform.

The lateral side of a corresponding electron emission region 24 contacts the isolate electrode 142 within a corresponding via hole 22 to receive the electric current required for the electron emission. The electron emission region 24 has a height smaller than the isolate electrode 142 such that the top surface of the electron emission region 24 is placed below the top surface of the isolate electrode 142.

That is, in this embodiment, the isolate electrode 142 has a height greater than that of the electron emission region 24 such that it surrounds the top surface of the electron emission region 24. The side periphery of the electron emission region 24 is not exposed to the vacuum atmosphere, while only the top surface thereof is exposed to the vacuum atmosphere. With the operation of the electron emission display device, the isolate electrode 142 alters the field distribution around the electron emission region 24, and reduces the initial diffusion angle of the electrons emitted from the electron emission region 24.

The electron emission regions 24 may be formed with a material for emitting electrons when an electric field is applied thereto under the vacuum atmosphere, such as a carbonaceous material and/or a nanometer (nm) size material. For instance, the electron emission regions 24 may be formed with carbon nanotube, graphite, graphite nanofiber, diamond, diamond-like carbon, fullerene $C_{60}$, silicon nanowire, or a combination thereof.

With the above structure where the electron emission region 24 is within (or partially fills) the via hole 22 of the isolate electrode 142, a separate process for patterning the electron emission regions 24 is not required (i.e., the above structure can have the same result as in micro-patterning the electron emission regions 24).

Openings 161 and 181 are respectively formed at the insulating layer 16 and the gate electrodes 18 to correspond to the respective electron emission regions 24 to expose the electron emission regions 24 on the first substrate 10. A corresponding opening 161 of the insulating layer 16 and a corresponding opening 181 of the gate electrodes 18 are greater in width (or in size) than a corresponding via hole 22 of the isolate electrode 142 mounting a corresponding electron emission region 24 therein.

FIGS. 1 and 3 illustrate the case where one isolate electrode 142 is placed at the sub-pixel, and circular-shaped electron emission regions 24 are serially placed at the respective isolate electrodes 142 in the longitudinal direction of the main electrode 141. However, the arrangement structure, number and plane shape of the isolate electrodes 142 and the electron emission regions 24 for the respective sub-pixels are not limited to the illustrated, and may be altered in various suitable manners.

Figure 4:
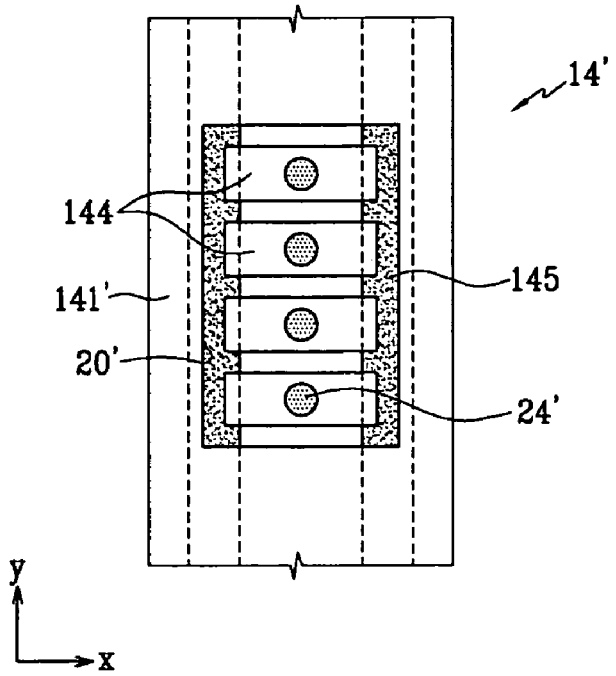
FIG. 4 is a partial amplified plan view of a cathode electrode and an electron emission region with an electron emission display device according to a second embodiment of the present invention.

As shown in FIG. 4, with a cathode electrode 14' of an electron emission display device according to a second embodiment, a plurality of isolate electrodes 144 are arranged within an opening portion 20' of a main electrode 141' in the longitudinal direction of the main electrode 141' such that they are spaced apart from each other with a distance therebetween. Resistance layers 145 are stripe-patterned at both sides of the isolate electrodes 144 in the longitudinal direction of the main electrode 141'.

Figure 5:
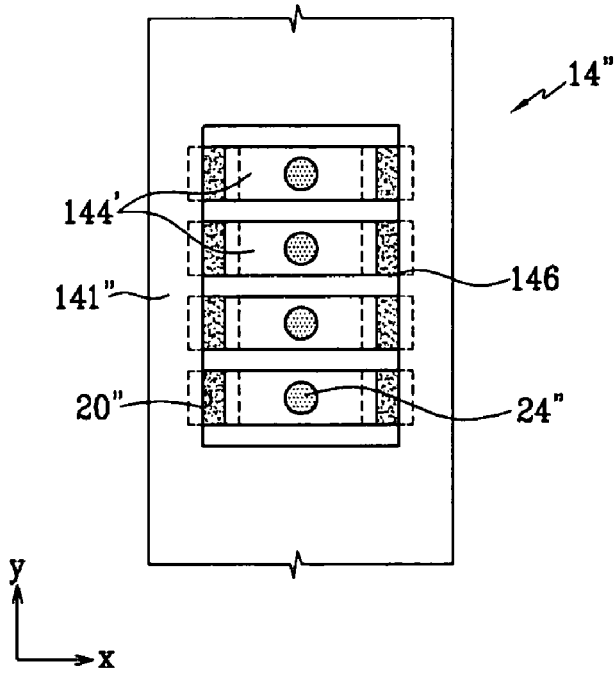
FIG. 5 is a partial amplified plan view of a cathode electrode and an electron emission region with an electron emission display device according to a third embodiment of the present invention.

As shown in FIG. 5, with a cathode electrode 14" of an electron emission display device according to a third embodiment, a plurality of isolate electrodes 144' are arranged within an opening portion 20" of a main electrode 141" in the longitudinal direction of the main electrode 141" such that they are spaced apart from each other with a distance therebetween. Resistance layers 146 are formed at both sides of each isolate electrode 144' between the main electrode 141" and the isolate electrodes 144'.

With the structures according to the second and the third embodiments, a resistance is separately applied between the main electrode 141' or 141" and the isolate electrode 144 or 144' for each electron emission regions 24' or 24" to more effectively stabilize the emission characteristics of the respective electron emission regions 24' or 24".

Furthermore, instead of having a circular planar shape, the electron emission regions 24 may have a rectangular planar shape, an oval planar shape, or any other suitable shape. In these alternative shape embodiments, the openings 161 and 181 of the insulating layer 16 and the gate electrodes 18 should have a planar shape corresponding to the electron emission regions 24.

Referring back to FIGS. 1 and 2, phosphor layers 26 are formed on a surface of the second substrate 12 facing the first substrate 10. The phosphor layers 26 have red, green, and blue phosphor layers 26R, 26G, and 26B spaced apart from each other with a distance therebetween, and a black layer 28 is formed between the neighboring red, green, and blue phosphor layers 26R, 26G, and 26B to enhance the screen contrast. A one-color phosphor layer 26R, 26G, or 26B is provided to correspond to one sub-pixel, and three sub-pixels with the red, green and blue phosphor layers 26R, 26G and 26B collectively from one pixel.

An anode electrode 30 is formed on the phosphor and black layers 26 and 28 with an aluminum-like metallic material. The anode electrode 30 receives a high voltage required for accelerating the electron beams from the outside, and sustains the phosphor layer 26 to be in a high potential state. Furthermore, the anode electrode 30 reflects the visible rays radiated from the phosphor layer 26 to the first substrate 10 toward the side-of the second substrate 12 to heighten the screen luminance.

In addition, the anode electrode may be formed with a transparent conductive layer (not shown) based on indium tin oxide (ITO), and in this case, the anode electrode is placed on a surface of the phosphor and black layers 26 and 28 directed toward the second substrate 12 (i.e., the anode electrode is between the second substrate 12 and the phosphor and black layers 26 and 28). Furthermore, it is also possible to simultaneously form a transparent conductive layer and a metallic layer as the anode electrode.

Spacers 32 are disposed between the first and second substrates 10 and 12 to support the pressure applied to the vacuum vessel and maintain a substantially constant distance between the first and second substrates 10 and 12. A spacer 32 is located at the area of a corresponding black layer 28 such that it does not intrude upon the area of a corresponding phosphor layer 26.

The above-structured electron emission display device is operated by applying voltages (which may be predetermined) from the outside to the cathode electrodes 14, the gate electrodes 18, and the anode electrode 30.

For instance, it is possible that one of the cathode electrode 14 or the gate electrode 18 receives the scan driving voltage to function as a scan electrode, and the other electrode receives a data driving voltage to function as a data electrode. The anode electrode 30 receives a voltage required for accelerating the electron beams, such as a direct current voltage from several hundreds to several thousands of volts.

An electric field is formed around the electron emission region 24 at the sub-pixel where the voltage difference between the cathode and gate electrodes 14 and 18 exceeds the threshold value, and electrons are emitted from the electron emission region 24. The emitted electrons are attracted by the high voltage applied to the anode electrode 30, thereby colliding against the phosphor layer 26 at the relevant sub-pixel and emitting light.

The resistance layer 143 uniformly controls the emission characteristics of one or more of the electron emission regions 24 to heighten the light emission uniformity of the sub-pixels. Simultaneously, the isolate electrode 142 alters the field distribution around the electron emission regions 24 and reduces the initial diffusion angle of the electron beams to thereby enhance the screen color purity.

Figure 6:
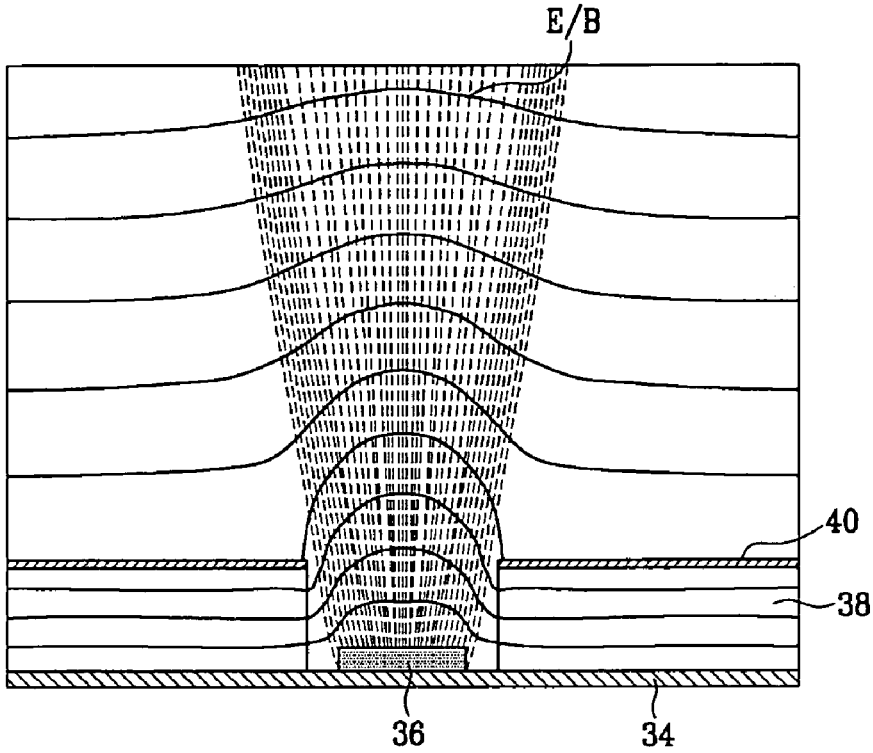
FIG. 6 is a partial sectional view of an electron emission display device according to a Comparative Example, illustrating potential distributions and electron beam trajectories around an electron emission region.
Figure 7:
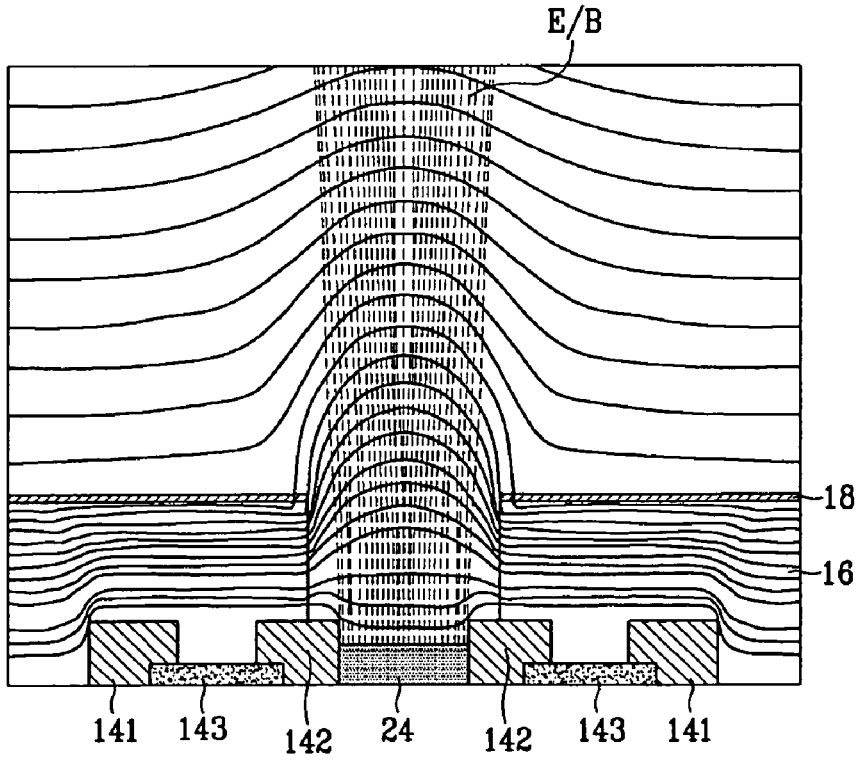
FIG. 7 is a partial sectional view of an electron emission display device according to Example, illustrating potential distributions and electron beam trajectories around an electron emission region.

FIGS. 6 and 7 illustrate potential distributions and electron beam trajectories around an electron emission region with electron emission display devices according to a Comparative Example and an Example.

The electron emission display device according to the Comparative Example has stripe-patterned cathode electrodes 34. In the Comparative Example, the electron emission display device has an electron emission region 36, an insulating layer 38, and a gate electrode 40. In both of the Comparative Example and the Example, the results of the simulations are obtained when 0V is applied to the cathode electrode, 80V is applied to the gate electrode, and 5 kV is applied to the anode electrode.

As shown in FIG. 6, with the electron emission display device according to the Comparative Example, only convex equipotential lines toward the second substrate (not shown) are formed over the electron emission region 36. With such a potential distribution, and the electrons emitted from the electron emission region 36 bear a large initial diffusion angle (which may be predetermined).

By contrast, as shown in FIG. 7, with the electron emission display device according to the Example, as the isolate electrode 142 has a height greater than the height of the electron emission region 24, one or more concave equipotential lines toward the second substrate (not shown) are formed over the electron emission region 24. With the altered potential distribution, the electron beams are focused while passing through the via holes (e.g., 22) of the isolate electrode 142 so that they have an initial diffusion angle smaller than that of the Comparative Example.

Accordingly, with the electron emission display device according to the present embodiment, the spreading of electron beams is minimized, and the spot size of the electron beams landing on the second substrate 12 is reduced. Furthermore, the electron beams are prevented from intruding upon the area of incorrect colors (e.g., incorrect phosphor layers), thereby enhancing the screen color purity.

Figure 8:
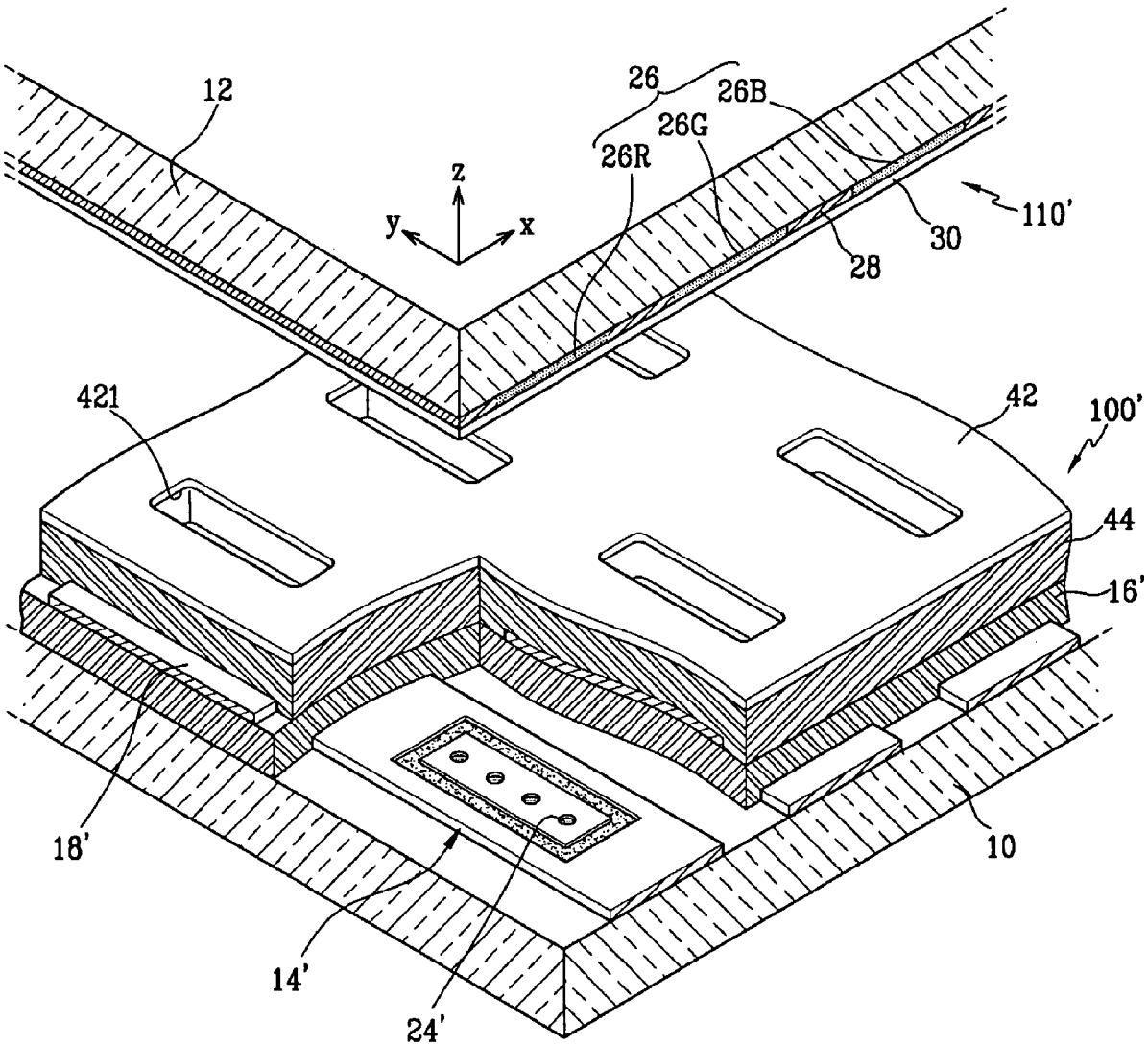
FIG. 8 is a partial exploded perspective view of an electron emission display device according to a fourth embodiment of the present invention.

As shown in FIG. 8, with an electron emission display device according to a fourth embodiment of the present invention, a focusing electrode 42 is formed over gate electrodes 18' to focus the electron beams. A first insulating layer 16' is disposed between the cathode and gate electrodes 14' and 18', and a second insulating layer 44 is provided under the focusing electrode 42 to insulate the focusing electrode 42 from the gate electrodes 18'.

A plurality of openings (not shown) may be formed at the focusing electrode 42 corresponding to the electron emission regions 24' to separately focus the electrons emitted from the respective electron emission regions 24'. Alternatively, as shown in FIG. 8, one opening 421 may be formed for each sub-pixel to collectively focus the electrons emitted for the sub-pixel.

The focusing electrode 42 receives OV or a negative direct current voltage of several to several tens of volts during the operation of the electron emission display device. The focusing electrode 42 provides a repulsive force to the electrons passed through the opening 421, and focuses the electrons to the center of the bundle of electron beams from the electron emission regions 24'.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission device comprising:

a substrate;

a cathode electrode formed on the substrate;

a gate electrode crossing the cathode electrode and insulated from the cathode electrode; and an electron emission region electrically connected to the cathode electrode, wherein the cathode electrode comprises a main electrode with an inner opening portion, an isolate electrode placed in the opening portion and spaced apart from the main electrode by a distance, and a resistance layer disposed between the main electrode and the isolate electrode, the isolate electrode having a via hole, wherein the electron emission region contacts the isolate electrode, and is placed in the via hole, and wherein the isolate electrode has a first height, and the electron emission region has a second height smaller than the first height.

2. The electron emission device of claim 1, wherein the main electrode and the isolate electrode partially cover a top surface of the resistance layer.

3. The electron emission device of claim 2, wherein each of the main electrode and the isolate electrode is thicker than the resistance layer.

4. The electron emission device of claim 1, wherein the via hole comprises a plurality of via holes, and wherein the isolate electrode is located at a cross region of the cathode and gate electrodes, and has the plurality of via holes arranged in a direction of the substrate.

5. The electron emission device of claim 4, wherein the resistance layer having a predetermined width surrounds the periphery of the isolate electrode.

6. The electron emission device of claim 1, wherein the isolate electrode comprises a plurality of isolate electrodes placed within the opening portion of the main electrode and spaced apart from each other by a distance.

7. The electron emission device of claim 6, wherein the resistance layer is formed at both sides of each of the plurality of isolate electrodes and between the main electrode and the plurality of isolate electrodes.

8. The electron emission device of claim 1, further comprising a focusing electrode placed over the cathode electrode and the gate electrode and insulated from the cathode electrode and the gate electrode.

9. An electron emission display device comprising:

a first substrate;

a second substrate facing the first substrate;

a cathode electrode formed on the first substrate;

a gate electrode crossing the cathode electrode and insulated from the cathode electrode;

an electron emission region electrically connected to the cathode electrode;

a phosphor layer formed on a surface of the second substrate; and an anode electrode formed on a surface of the phosphor layer, wherein the cathode electrode comprises a main electrode with an inner opening portion, an isolate electrode placed in the opening portion and spaced apart from the main electrode by a distance, and a resistance layer disposed between the main electrode and the isolate electrode, the isolate electrode having a via hole, wherein the electron emission region contacts the isolate electrode, and is placed in the via hole, and wherein the isolate electrode has a first height, and the electron emission region has a second height smaller than the first height.

10. The electron emission display device of claim 9, wherein the main electrode and the isolate electrode partially cover a top surface of the resistance layer.

11. The electron emission display device of claim 10, wherein each of the main electrode and the isolate electrode is thicker than the resistance layer.

12. The electron emission display device of claim 9, wherein the via hole comprises a plurality of via holes, and wherein the isolate electrode is located at a cross region of the cathode and gate electrodes, and has the plurality of via holes arranged in a direction of the substrate.

13. The electron emission display device of claim 9, wherein the isolate electrode comprises a plurality of isolate electrodes placed within the opening portion of the main electrode and spaced apart from each other by a distance.

14. The electron emission display device of claim 13, wherein the resistance layer is formed at both sides of each of the plurality of isolate electrodes and between the main electrode and the plurality of isolate electrodes.

15. The electron emission display device of claim 9, further comprising a focusing electrode placed over the cathode electrode and the gate electrode and insulated from the cathode electrode and the gate electrode.

16. The electron emission display device of claim 9, wherein the isolate electrode is adapted to provide a concave equipotential line toward the second substrate and over the electron emission region.

17. An electron emission display device comprising:

a first substrate;

a second substrate facing the first substrate;

a cathode electrode formed on the first substrate;

a gate electrode crossing the cathode electrode and insulated from the cathode electrode;

an electron emission region electrically connected to the cathode electrode;

a phosphor layer formed on a surface of the second substrate; and an anode electrode formed on a surface of the phosphor layer, wherein the cathode electrode comprises a main electrode with an inner opening portion, an isolate electrode placed in the opening portion and spaced apart from the main electrode by a distance, and a resistance layer disposed between the main electrode and the isolate electrode, the isolate electrode having a via hole, wherein the electron emission region is placed in the via hole, and wherein the isolate electrode is adapted to provide a concave equipotential line toward the second substrate and over the electron emission region.

* * * * *